United States Patent [19]

Dear et al.

[11] Patent Number: 5,014,816

[45] Date of Patent: May 14, 1991

[54] SILENCER FOR GAS INDUCTION AND EXHAUST SYSTEMS

[75] Inventors: Terrence A. Dear, Elkton, Md.; Karl U. Ingard, Kittery Point, Me.; Mark E. Schuchardt, Pleasant Ridge, Mich.

[73] Assignee: E. I. du Pont de Nemours and Company, Wilmington, Del.

[21] Appl. No.: 434,959

[22] Filed: Nov. 9, 1989

[51] Int. Cl.[5] ..... E02M 35/00

[52] U.S. Cl. ..... 181/229

[58] Field of Search ..... 181/229, 230, 265, 268, 181/273, 206, 250, 266

[56] References Cited

U.S. PATENT DOCUMENTS

| | | | |
|---|---|---|---|
| 2,096,260 | 10/1937 | Pavillon | 181/265 |
| 2,297,046 | 9/1942 | Bourne | 181/250 |
| 3,739,874 | 6/1973 | Plaga, III | 181/250 |
| 3,998,614 | 12/1976 | Schonberger et al. | 55/417 |
| 4,319,549 | 3/1982 | Yoneda et al. | 181/204 |
| 4,416,350 | 11/1983 | Hayashi | 181/273 X |
| 4,418,443 | 12/1983 | Fisher | 181/250 X |
| 4,800,985 | 1/1989 | Hanzawa et al. | 181/229 |

FOREIGN PATENT DOCUMENTS

| | | | |
|---|---|---|---|
| 0091038 | 10/1983 | European Pat. Off. . | |
| 1344921 | 10/1987 | U.S.S.R. | 181/250 |

*Primary Examiner*—Brian W. Brown

*Attorney, Agent, or Firm*—James T. Corle

[57] ABSTRACT

A silencer having multiple integrated channels arranged in a labyrinth configuration is provided. The channels have one open end and one closed end with the open end in communication with a common zone which is connected to a flow duct. The channels are tuned to provide a selected resonance frequency.

10 Claims, 5 Drawing Sheets

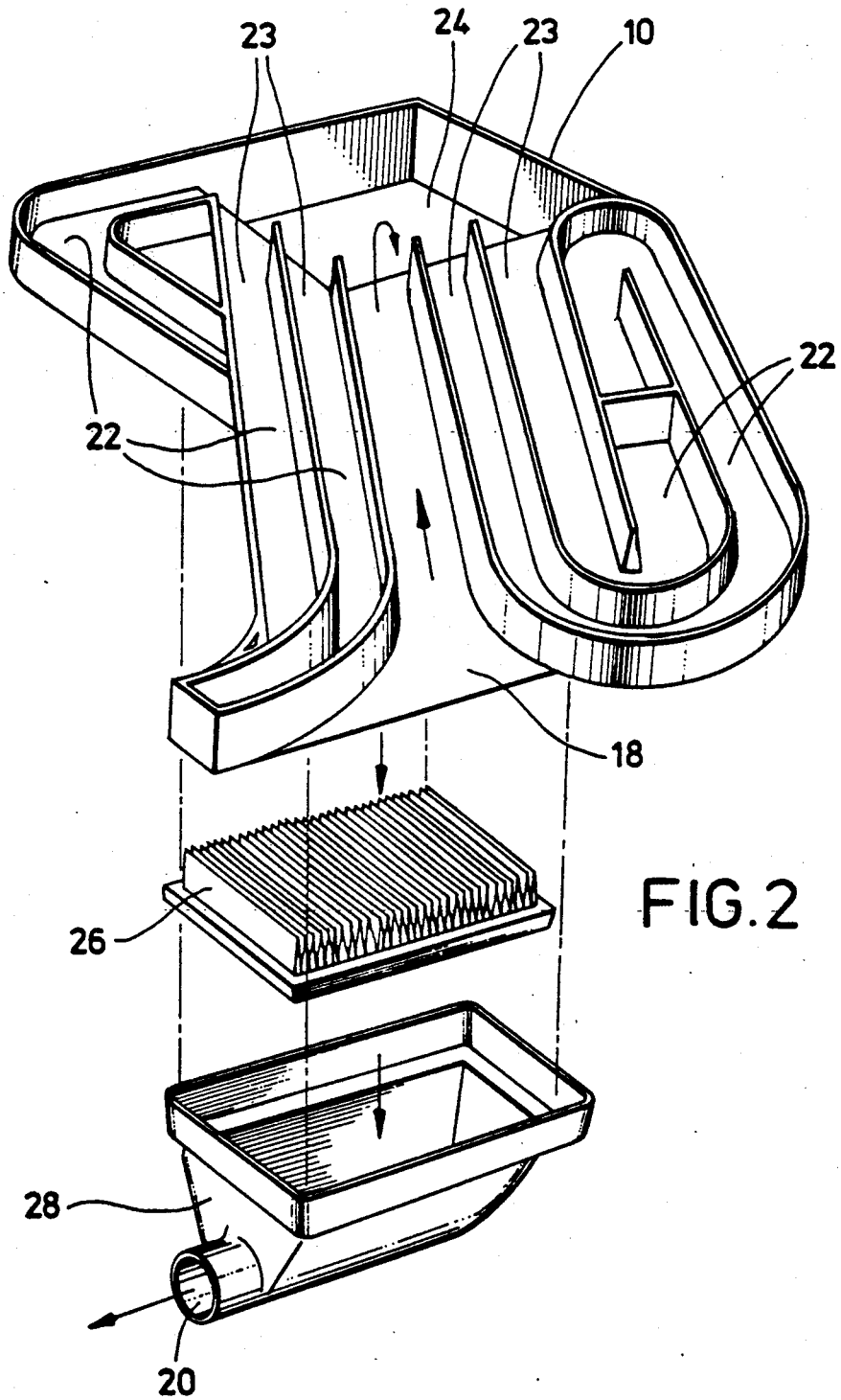
FIG.2
FIG.10
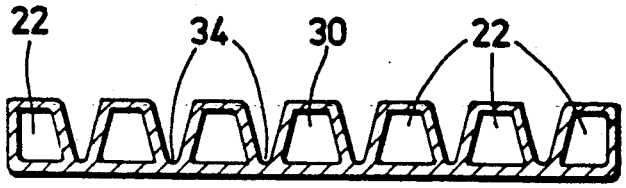

SILENCER FOR GAS INDUCTION AND EXHAUST SYSTEMS

BACKGROUND OF THE INVENTION

Field of the Invention

This invention relates to a silencer for gas induction and exhaust systems. More particularly, the invention relates to an air induction system for an internal combustion engine comprising a novel silencer having a labyrinth configuration. The labyrinth configuration makes possible the packaging of an effective low frequency silencer in a limited space such as is characteristic of the engine compartment of an automobile.

A major source of noise from a gas induction or exhaust system of an internal combustion engine is the pulsating air flow the air intake valves in the cylinders resulting from the oscillatory motion of the pistons in the cylinders. The noise propagates in the flow duct which carries the air to the engine and can be characterized as a low frequency induction tone with a fundamental frequency $f_o$ which is proportional to the engine rpm. For a four-cycle engine, this frequency can be computed from $$f_o = CN/120$$

where C is the number of cylinders and N the rpm of the engine. For example, in a four cylinder engine the induction tone will have a frequency of 100 Hz at 3000 rpm. For an internal combustion engine, this frequency typically is less than 500 Hz, and in this low frequency range, the noise is transmitted through barriers and partitions, for instance into the passenger compartment in an automobile, with relatively little attenuation in comparison with noise at higher frequencies.

In view of the growing trend toward compact engine compartment design, the problem of effectively attenuating the low frequency (long wavelength) air induction noise has become increasingly more difficult because of space limitations. This is acknowledged in U.S. Pat. No. 4,800,985 which discloses the use of a side-branch tube which is either flexible or has a flexible portion. The tube is essentially a straight pipe configuration having a cross sectional area significantly smaller than that of the flow duct. The patentees refer to the tube as a high frequency attenuator implying that a tube long enough to cover the important low frequency end of the noise spectrum would exceed installation space limitations.

Another form of silencer is disclosed in U.S. Pat. No. 2,096,260. Damping tubes of considerable length closed at one end are positioned to cause sudden changes or reversals in direction of the path of the fluid flow within the damping tubes. These tubes are not relevant to the present invention since they are not resonator tubes but, to the contrary, are tubes which are designed to absorb the sound that enters into them, so that no resonance can occur. To achieve such absorption, the tubes are filled with porous material or provided with some other means of sound absorption.

There is a need for a silencer which is effective in attenuating low frequency noise and at the same time can be configured for placement in a confined space.

SUMMARY OF THE INVENTION

In accordance with the present invention there is provided a silencer for a gas induction or exhaust system having a labyrinth configuration comprising a housing having incorporated therein a plurality of paritions defining multiple integrated channels which are open at one end and closed at the other end. The open ends of the channels communicate with a common zone which is connected to a flow duct. Each channel is tuned to provide a selected resonance frequency.

With the labyrinth silencer of this invention, through its unique configuration, it is possible to incorporate multiple channels which function as side-branch resonator tubes while maintaining compatability with limited space requirements in an engine compartment. Generally, two or more and preferably up to five channels are needed for the effective silencing the air induction noise in an automobile engine. The number selected is not critical and will be influenced by space and design considerations. When used with an automobile engine, the location of the common zone referred to above is as close to the noise source, i.e. cylinder valves, as possible.

The channels may be straight tubes or curved, and adjacent channels may have common side walls. One or more of the channels may be turned at a 90 degree angle or may be completely folded back on itself. The cross sectional configuration of the channels can be varied; however, in a preferred embodiment the cross sectional area of each channel should be substantially uniform throughout its length. The silencer can be packaged in the form of a panel with the thickness dimension much smaller than the width and the length, and having a shape which permits installation in a "low priority" space in the engine compartment or directly on the hood or on the firewall of an automobile. It is generally preferred that the silencer have a unitary structure; however, components can be separately fabricated and thereafter assembled. In either case, the silencer can be designed so that adjacent channels may share a common wall.

In addition to providing effective attenuation of the induction noise, the labyrinth silencer has been found to provide an increase in engine performance, i.e. torque vs. speed, in comparison with performance obtained with known air induction systems.

The attenuation which can be achieved by the labyrinth silencer depends on the ratio of the cross sectional area of each channel to the cross sectional area of the flow duct. Preferably, this ratio should be larger than 0.5. This ratio can be achieved by a single channel or by summing the cross sectional areas of multiple channels with identical or overlapping band widths. The upper limit of the cross sectional area ratio will be controlled by space and design considerations.

BRIEF DESCRIPTION OF THE DRAWINGS

FIG. 2 is an exploded fragmentary view of the silencer shown in FIG. 1 with the cover portion removed to expose multiple channels.

FIG. 10 is a sectional view taken along line X—X of FIG. 9.

DETAILED DESCRIPTION

Figure 1:
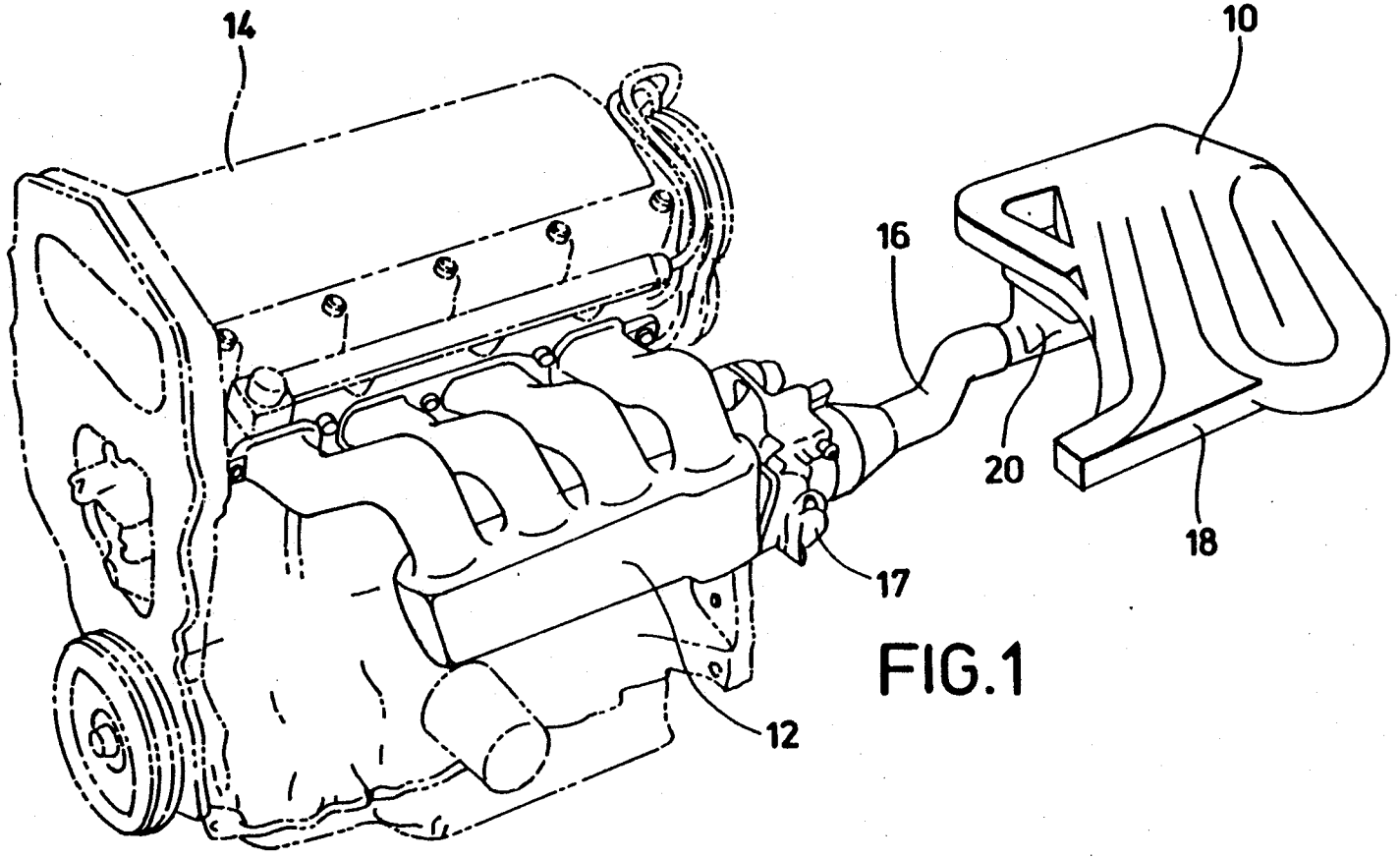
FIG. 1 is a perspective view of one embodiment of a silencer of the present invention incorporated in the air induction system of an internal combustion engine.

Referring to FIG. 1, one embodiment of the silencer of this invention is shown as a component of an air induction system for an internal combustion engine. Housing 10 which encloses a number of channels and a common zone of communication for the channels provides for the passage of air from the atmosphere to the intake manifold 12 of internal combustion engine 14. Flexible duct 16 connects housing 10 to throttle body 17 which is in turn connected to manifold 12. Air inlet 18 permits the passage of air into housing 10, and air outlet 20 permits the passage of air from housing 10 through flexible duct 16 to manifold 12.

The path taken by air entering air inlet 18 is shown in FIG. 2. It goes through the flow duct to common zone 24 and then to air filter 26 which is contained in filter box 28. In this exploded fragmentary view it can be seen that channels 22 all have open ends 23 which communicate with a common zone 24. The other ends of all channels are closed. Channels 22 do not carry any mean flow of air; the flow is confined to common zone 24 and only grazes and does not enter the open ends (ports) of the channels.

Figure 3:
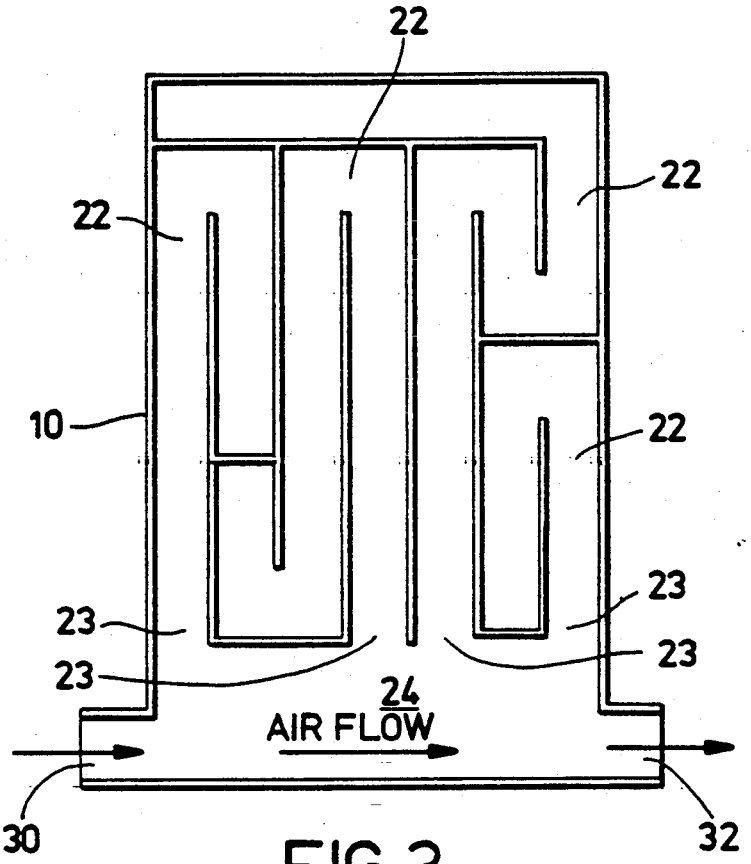
FIG. 3 is a simplified schematic view of a silencer showing the relationsip of channels to a common communication zone in a flow duct.

The silencer of this invention is not limited in the number of channels which can be provided or to any particular configuration of the channels. FIG. 3 is a simplified illustration showing a housing 10 enclosing four channels 22. The channels are integrated into a unit with their open ends communicating with common zone 24. Inlet 30 and outlet 32 are interconnected through common zone 24. An almost limitless combination of folding angles, i.e. the angle at which a channel departs from a straight line, is possible.

For optimum performance, the silencer must be configured for the particular engine with which it will be used. The preferred embodiment for a particular application may be made by following selected noise control engineering principles.

(a) A channel should be tuned to provide a resonance frequency as close as possible to the induction tone which is to be attenuated. It should be noted that the required length of the channel increases as the frequency of the induction tone decreases. Other channels can be tuned to higher harmonics and frequencies to achieve broad based attenuation, particularly at those frequencies related to engine speed.

(b) The minimum cross sectional area of each resonator channel should be a substantial fraction, preferably larger than 0.5, of the minimum cross sectional area of the flow duct as measured where the channel interconnects with the common zone of communication (for example, in FIG. 3 at inlet 30). The flow duct for purposes of this invention comprises that section of duct between the common zone of communication and the gas source region and/or between that zone and the gas receiving region. Duct sections that run between or interconnect the zone of communication and the noise source are not considered part of the flow duct as decribed herein.

(c) The attenuation provided by the labyrinth silencer depends on the location of the zone of communication along the flow duct. The preferred location is at the engine end of this duct as close to the noise source as possible, particularly since such an engine is a high impedence source. In general, location of the zone of communication relative to the noise source is determined on the basis of noise source impedence.

A channel, with a uniform cross section, acts like an acoustic resonator with a fundamental resonance frequency $$f_1 = c/4L$$

where c is the sound speed and L the length of the channel (including the "end correction" which is of the order of the hydraulic radius of the channel). The "bandwidth", df, of a resonance is often expressed by the damping factor $D = df/f_1$ or its inverse, the "Q-value". It is affected by visco-thermal losses at the interior walls of the channel and by the grazing flow over the channel entrance or port (often the dominant damping effect). The lengths and Q-values of the different channels are chosen so that attenuation of the labyrinth silencer covers the relevant rpm range of the engine.

Figure 4:
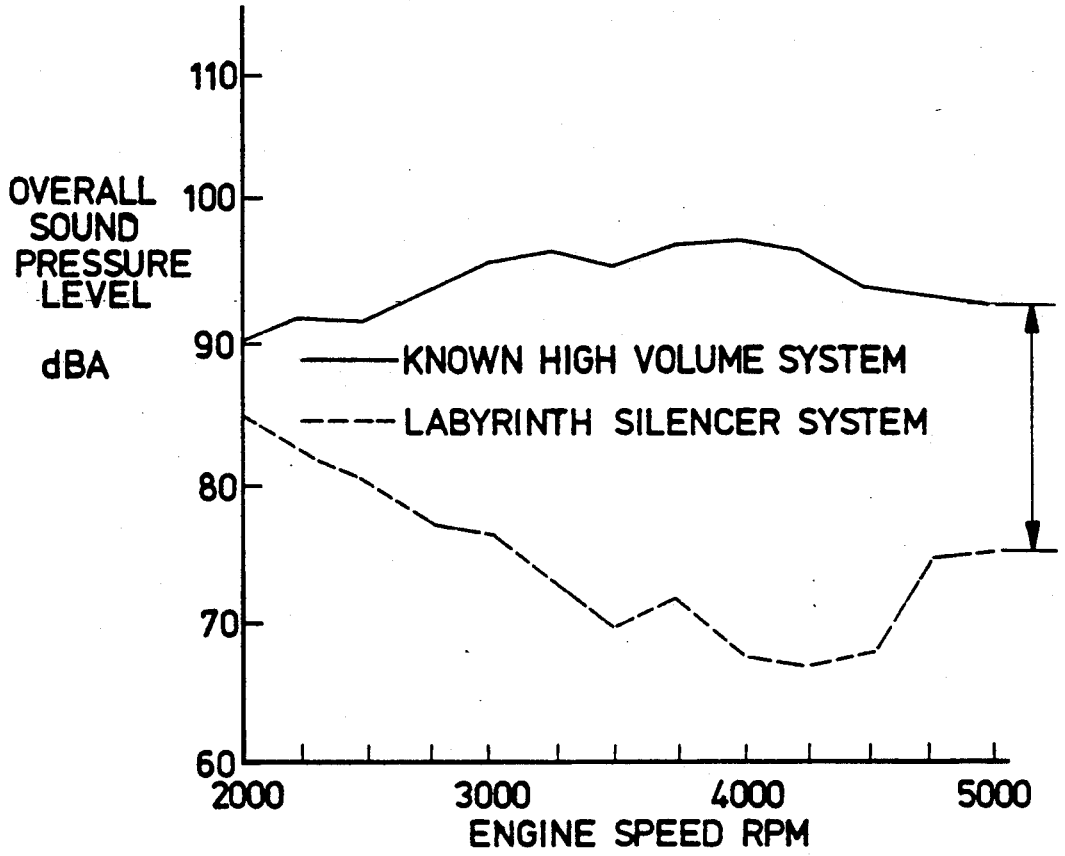
FIG. 4 is a graph showing noise attenuation of the silencer for the induction tone as a function of engine rpm relative to a known silencer system.

Referring now to FIG. 4, it can be seen from the graph that the silencer of this invention provides a significant improvement in noise attenuation when compared to a known, i.e. conventional high-volume attenuator system.

The data for the graph shown in FIG. 4 were obtained from a series of engine acceleration tests on a chassis dynamometer using a silencer of this invention and comparing its performance to the performance of a known system. The silencer of this invention was fabricated by blow molding a fiberglass reinforced epoxy resin. The silencer was installed on an Oldsmobile Calais automobile having a high output "Quad 4" engine. Testing was conducted on a motoring chassis dynamometer. Performance was evaluated by timed acceleration runs against an inertial load of 3125 lbs. Data were recorded over a 5000 rpm operating band. The noise level was measured while motoring the engine with the dynamometer in order to eliminate combustion noise. Using the silencer of this invention, consistent improvement of insertion loss values of over 20 decibels was achieved over a wide range of rpm and frequencies.

Figure 5:
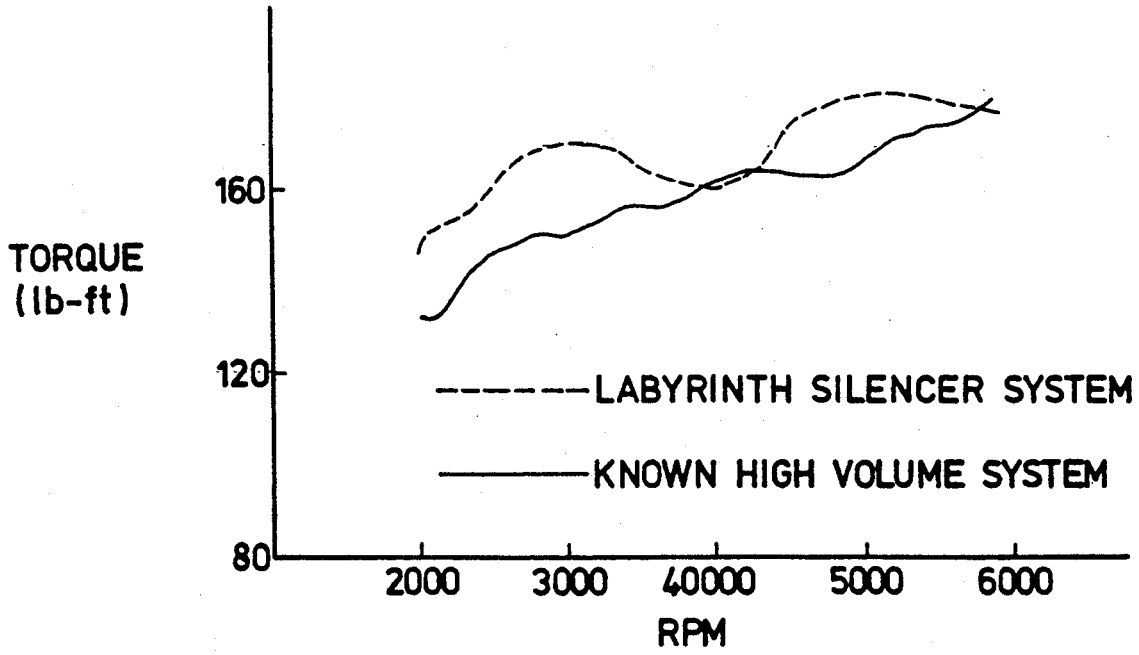
FIG. 5 is a graph showing improvement in engine performance through use of the silencer of this invention.

In addition to improved acoustic performance, the labyrinth silencer of this invention has been found to give improved engine efficiency The results of a series of tests performed to determine relative changes in performance are shown graphically in FIG. 5. An inertial load was set at 3125 lbs. All of the acceleration tests were performed with the vehicle described above in 3rd gear. A series of full throttle accelerations tests were performed in the range of 1000 to 6000 rpm. The results of the tests using the silencer of this invention and a silencer as originally installed on the Oldsmobile Calais show the improvement in engine performance when using the silencer of this invention. As shown in FIG. 5, the labyrinth silencer system increased engine torque, particularly at low speeds. The torque increase is believed to be the result of lower back presssure in the labyrinth system and acoustically induced supercharging.

Figure 6:
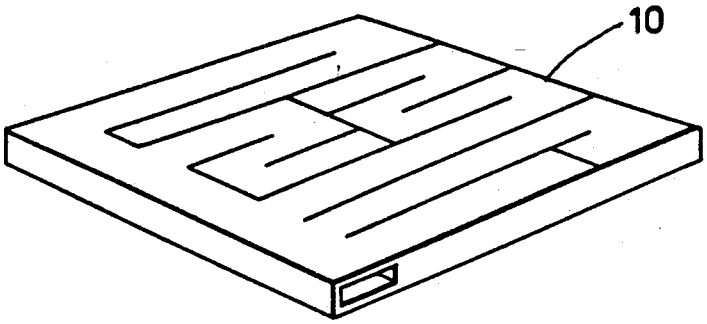
FIGS. 6, 7 and 8 are schematic illustrations of different shapes for the silencer.
Figure 7:
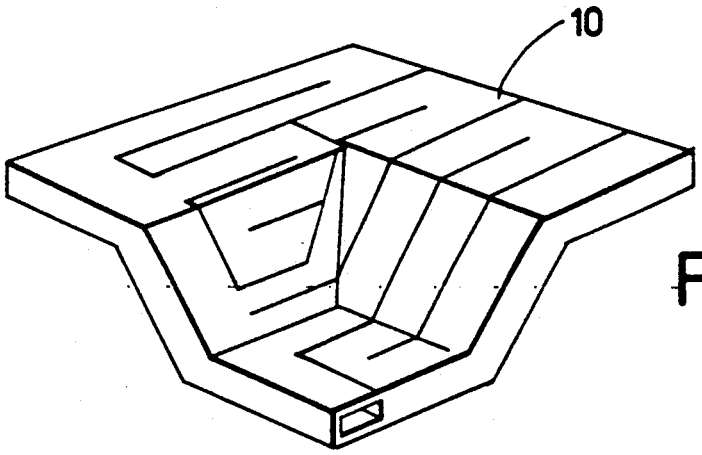
Figure 8:
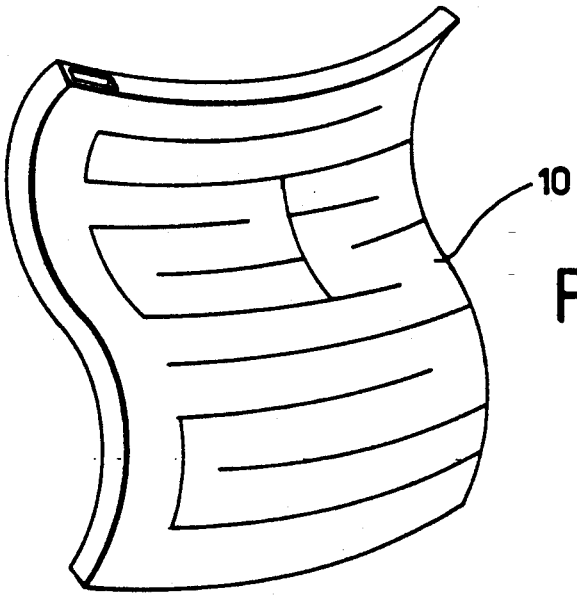

The labyrinth configuration of the silencer of this invention lends itself to highly efficient manufacturing processes, including, but not limited to, blow molding. A large variety of configurations such as those illustrated in FIGS. 6, 7 and 8 as well as ones in which the panel is folded on itself can be made to utilize available space. This flexibility makes it possible to satisfy simultaneously the requirements for packaging, noise reduction, engine performance, appearance, easy access to the filter element and production requirements.

Figure 9:
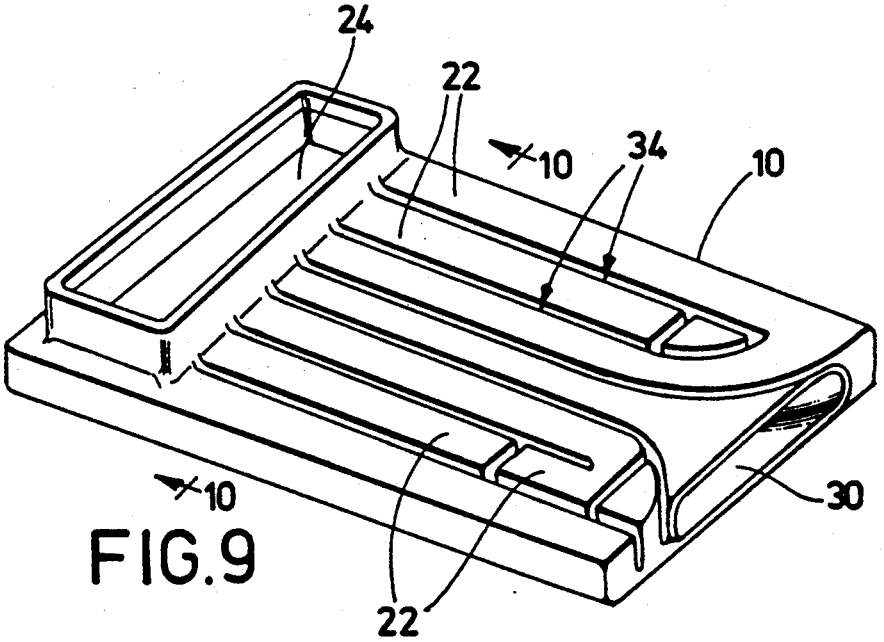
FIG. 9 is a perspective view of another embodiment of the silencer of the present invention showing fabrication elements.

Another embodiment of the silencer of this invention is shown in FIG. 9. In the manufacture of this silencer multiple channels 22 are formed by linear parallel "tack-offs" 34 in a blow molding process. Inlet 30 is formed by trimming flash from the body of housing 10. FIG. 10 is a sectional view taken along line X—X of FIG. 9.

The silencer can be fabricated using conventional molding and other forming techniques. A suitable molding resin or fibrous material is shaped to conform to whatever space may be available for its installation. A wide range of materials may be used in the construction of the silencers such as metals, fibrous and polymeric materials. Light weight polymeric materials including engineering plastics, e.g. thermoplastic and thermosetting resins as well as composites containing reinforcing fibers are preferred. Among the many suitable materials are polymers and copolymers such as polyamides, polyesters, polyolefins, polyurethanes, polyexpoxides, polystyrene and polycarbonates. Materials which can be formed by a blow molding process are particularly preferred.

While the silencer of this invention has been described for use in the induction system of an internal combustion engine, it is to be understood that by following the teachings set for herein, one skilled in the art can adapted the silencer for use in exhaust systems as well as other systems. Other systems include reciprocating compressors, rotary positive displacement blowers and compressors, vacuum pumps, centrifugal machines, gas turbines and engines and combustion systems such as boilers and preheaters.

While particular structural configurations for the silencer of this invention have been illustrated, it is to be understood that the silencer is capable of further modifications and departures from the present disclosure as come within the known or customary practices in the art to which this invention pertains. Accordingly, it is intended that such modification and departures fall within the scope of invention as set forth in the claims which follow.

We claim:

1. A silencer for use in gas induction and exhaust systems comprising:

a housing having incorporated therein a plurality of partitions defining multiple integrated channels arranged adjacent to each other in a labyrinth configuration, each channel having an open end and a closed end, the open end of said channels being in communication with a common zone in said housing and a flow duct provided in said housing in communication with said common zone, said flow duct having an inlet and an outlet to permit the passage of gas through said common zone and through said flow duct, said channels being tuned to provide selected resonance frequencies.

2. The silencer of claim 1 having a unitary structure.

3. The silencer of claim 1 wherein each of said channels and said flow duct have a minimum cross sectional ratio greater than 0.5.

4. The silencer of claim 1 wherein at least a part of adjacent channels have a common wall.

5. The silencer of claim 3 formed from a polymeric material.

6. The silencer of claim 5 wherein selected channels have a folding angle greater than 90 degrees.

7. In an air induction system, a silencer comprising a housing having incorporated therein a plurality of partitions defining multiple integrated channels arranged adjacent to each other in a labyrinth configuration, each channel having an open end and a closed end, the open end of said channels being in communication with a common zone in said housing and a flow duct provided in said housing in communication with said common zone, said flow duct having an inlet and outlet to permit the passage of gas through said common zone and through said flow duct, said channels being tuned to provide selected resonance frequencies.

8. The air induction system of claim 7 wherein said silencer has a unitary structure.

9. The air induction system of claim 8 wherein selected channels have a folding angle greater than 90 degrees, and each of said channels and said flow duct have a minimum cross sectional ratio greater than 0.5.

10. The air induction system of claim 9 having a unitary structure.

* * * * *